US005444953A

United States Patent [19]

Koenig et al.

[11] Patent Number: 5,444,953

[45] Date of Patent: Aug. 29, 1995

[54] INTERIOR CORNER JOINT SIMULATING GROUT LINE FOR WALL BOARDS SIMULATING TILES EMBEDDED IN GROUT

[75] Inventors: Paul J. Koenig; Douglas F. Hutchings; David W. Gibbard, all of Lapeer; Richard C. Manwell, Millington, all of Mich.

[73] Assignee: Trayco, Inc., Lapeer, Mich.

[21] Appl. No.: 742,977

[22] Filed: Aug. 9, 1991

[51] Int. Cl.[6] ..... E04B 1/38

[52] U.S. Cl. ..... 52/282.1; 52/255; 52/288.1; 52/276; 52/278; 52/476; 52/773

[58] Field of Search ..... 52/282.1, 255, 288.1, 52/48.2, 764, 773, 183, 716, 242, 476, 287, 273, 276, 278, 465

[56] References Cited

U.S. PATENT DOCUMENTS

| | | | |
|---|---|---|---|
| 1,938,474 | 12/1933 | Wilhoyte | 52/256 |
| 3,206,806 | 9/1965 | Powell . | |
| 3,606,714 | 9/1971 | Arnett . | |
| 4,760,681 | 8/1988 | Harrison . | |

OTHER PUBLICATIONS

Plastics Engineering Handbook by the Society of the Plastics Industry, Inc.; 1976. Pp. 598–599.

*Primary Examiner*—Carl D. Friedman
*Assistant Examiner*—Wynn Wood
*Attorney, Agent, or Firm*—Myron B. Kapustij; Malcolm L. Sutherland

[57] ABSTRACT

An interior corner joint for joining wall board panels, particularly wall board panels simulating tiles embedded in grout, in a corner. The interior corner joint comprises a first base section; a second base section extending upwardly from said first base section and being perpendicular to said first base section; a rib extending upwardly from said first base section disposed adjacent to said second base section and canted toward said second base section, said rib, second base section, and first base section defining a channel adapted to receive a first wall board panel; and a flange at the distal end of said rib extending outwardly from said rib and inclined toward said first base section, said rib, flange and first base section defining a second channel adapted to receive a second wall board panel in substantially perpendicular relationship to said first wall board panel. With the two wall board panels inserted into the two channels the only exposed part of the joint is the flange. The flange can be provided with a concave outer surface to simulate a corner grout line.

4 Claims, 2 Drawing Sheets

INTERIOR CORNER JOINT SIMULATING GROUT LINE FOR WALL BOARDS SIMULATING TILES EMBEDDED IN GROUT

FIELD OF THE INVENTION

This invention relates to an interior corner joint simulating a grout line for joining together sections of wall board simulating tiles embedded in grout.

BACKGROUND OF THE INVENTION

Tiled walls have long been popular, particularly for bathrooms, kitchens, and the like. In spite of the popularity of tiled walls, these walls present certain problems. First, the grout may become a breeding place for stain producing mildew. Once stained the grout is extremely difficult to clean since it is porous and the stain may permeate through the grout. Secondly, the grout may loosen and fall out of the spaces between the tiles. Once the grout is cracked moisture may seep in behind the tiles and loosen them from the supporting wall. In addition, tile is difficult to install in perfectly straight lines. Also, tile is relatively expensive and time consuming to install compared to other walls.

Wall or tile boards simulating tiles embedded in grout, such as the one disclosed in application Ser. No. 123,487, filed Nov. 20, 1987, incorporated herein by reference, remedy these problems associated with tiled walls. Such wall boards are finding increased acceptance and usage. These wall boards typically are provided in large sections or panels, e.g. about four feet wide and about four feet high, about four feet wide by eight feet high, etc.

However, when two wall board panels meet and are joined at an angle of approximately 90°, such as for example at the corner or junction of two walls or a wall and a ceiling, an unsightly seam between the two abutting panels results. This seam can be eliminated by leaving a space between the wall panels in the corner, i.e., not having the two panels abut against each other in the corner, and filling this space with grout or caulking material to produce a grout line between the two panels. This procedure, however, is time consuming and requires additional effort to insure that the grout or caulking material is worked or shaped so as to have a concave outer surface simulating a grout line. Since the space filled by the grout or caulking material is in the corner, shaping this grout or caulking material to produce a concave outer surface is particularly cumbersome and difficult.

By use of the interior corner joint of this invention a simulated or artificial corner grout line is provided between two wall board panels meeting at a corner such as, for example, between two walls or a wall and a ceiling thereby providing an aesthetically appealing seamless appearance without the necessity of caulking or grouting between the wall board panels.

SUMMARY OF THE INVENTION

This invention is directed to an interior corner joint adapted to be used where two wall board panels meet at an angle of about 90° such as, for example, the juncture of two walls, the juncture of a wall and a ceiling, or a wall and a shelf. The interior corner joint, when placed in a corner between the juncture of two wall board panels, simulates a corner grout line. The corner joint is a long, narrow structure containing: a horizontal first base section having an inner edge and an outer edge; a vertical second base section having an inner edge and an outer edge extending upwardly from said first base section at the inner edge thereof and being substantially perpendicular to said first base section; a substantially vertical rib extending upwardly from said first base section toward the outer edge of said second base section disposed adjacent but spaced apart from said second base section and canted toward said second base section; and a flange at the distal end of said rib extending substantially horizontally toward the outer edge of said first base section and inclined toward said first base section. The outer surface of the flange is concave so as to simulate a corner grout line.

It is to be understood that whenever terms such as horizontal, vertical, upwardly and the like are used with respect to the first base section, second base section, rib and flange, they are used to describe the orientation of such elements as they are illustrated in FIGS. 1, 2, 3 and 5 of the drawings.

In actual application of the corner joint such terms may not accurately define or reflect the actual spatial orientation of such elements. Thus, for example, if the corner joint is disposed vertically in a corner between two walls the two base sections will actually extend horizontally, the ribs will extend outwardly from the first base section in a substantially horizontal direction, and the flange will extend from the rib in a substantially horizontal direction.

One wall board panel is inserted into a first channel defined by the rib, flange and first base section. The other wall board panel is inserted into a second channel defined by the rib, first base section, and second base section. The two wall board panels, when inserted into the corner joint, are substantially perpendicular to each other. The two base sections and the flange form a substantial right triangular configuration in cross-section with the two base sections forming the two sides of the triangle and the flange forming the hypotenuse of the triangle. After the wall board panels are inserted into the two channels in the corner joint the flange is the only part of the corner joint that is exposed, i.e., that is not covered by the panels. The exposed flange of the corner joint simulates a corner grout line, thereby giving the appearance that the entire underlying wall or substrate, including the corner, on which the corner joint and wall boards are mounted is covered with tiles embedded in grout.

DETAILED DESCRIPTION OF THE PREFERRED EMBODIMENT

Figure 1:
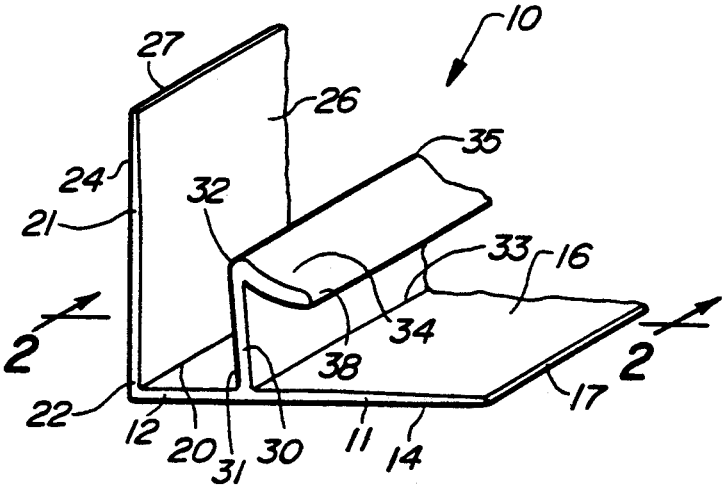
FIG. 1 is a top perspective view of the internal corner joint of this invention.
Figure 2:
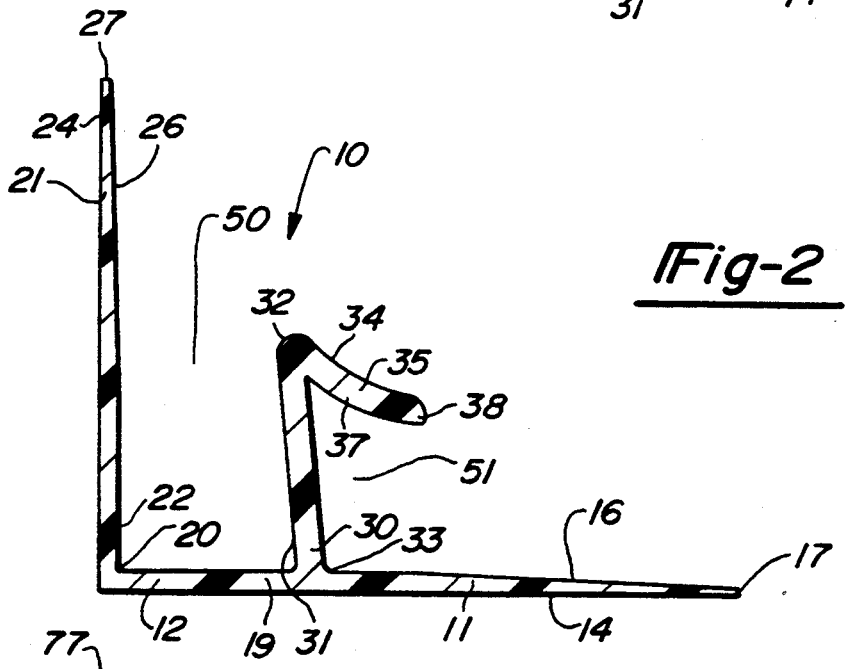
FIG. 2 is a cross-sectional view taken along line 2—2 in FIG. 1.

Referring to FIGS. 1 and 2 the interior corner joint of the instant invention is a long narrow structure comprised of a first horizontal base section 11, and a second vertical base section 21. Second vertical base section 21 is perpendicular to first base section 11 and joins or connects therewith at 20.

A rib 30 extends upwardly from horizontal base section 11 toward the outer edge 27 of base section 21. Rib 30 is joined to base section 11 at 33. Rib 30 is, as best illustrated in FIGS. 1 and 2, disposed adjacent to but spaced apart from, i.e., not in contact with, vertical base section 21. The spatial orientation of rib 30 can be described as substantially vertical because it is not perfectly vertical, i.e., it is not parallel to vertical base section 21 but is canted toward base section 21 with the interior side 31 of rib 30 forming an acute angle with horizontal base member 11. Rib 30 is canted or angled toward base section 21.

Rib 30, base element 21 and the inner portion 19 of base element define a channel 50.

Rib 30 has a narrow substantially horizontal flange 35 at its distal end 32. Flange 35 extends outwardly from rib 30 toward the outer edge 17 of base section 11. As best illustrated in FIG. 2 flange 35 is not parallel to base section 11 but is inclined toward base section 11. Flange 35 has a bottom side 37, a top surface 34 and an outer end 38. The top surface 34 of flange 35 is concave in cross-section to simulate a corner grout line. Flange 35 is preferably from about 0.25 to about 0.35 inch wide, i.e., the distance from distal end 32 to end 38 of the flange is preferably from about 0.25 to about 0.35 inch.

Flange 35, rib 30, and base section 11 define channel 51.

Base section 11, base section 21, rib 30 and flange 35 are preferably all integral.

Base sections 11 and 21, as best illustrated in FIG. 2, preferably have flat bottom surfaces 14, 24. Bottom surfaces 14 and 24 which are adapted to be next to and in surface-to-surface contact with the underlying wall. Base sections 11 and 21 preferably also have beveled top surfaces 16, 26 so that they are preferably tapered toward their outer edges 17, 27, being thickest at their inner edges 12, 22 and thinnest at their outer edges 17, 27. Base sections 11 and 21 are preferably about 0.01 to about 0.03 inch thick at their outer edges 17, 27 and from about 0.02 to about 0.05 inch thick at their inner edges 12, 22.

Figure 3:
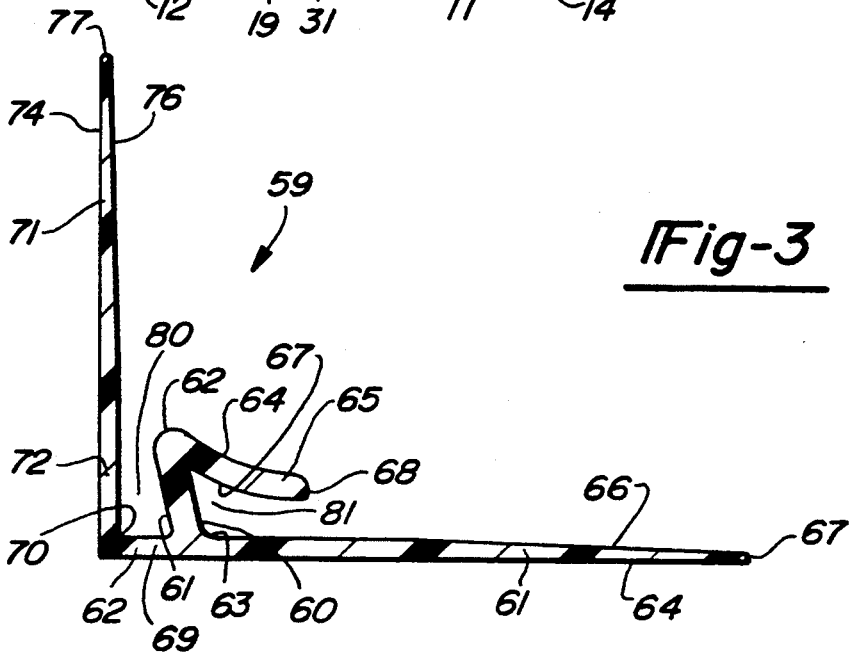
FIG. 3 is a cross-sectional view similar to FIG. 2 except that it shows another embodiment of the interior corner joint of the invention.
Figure 4:
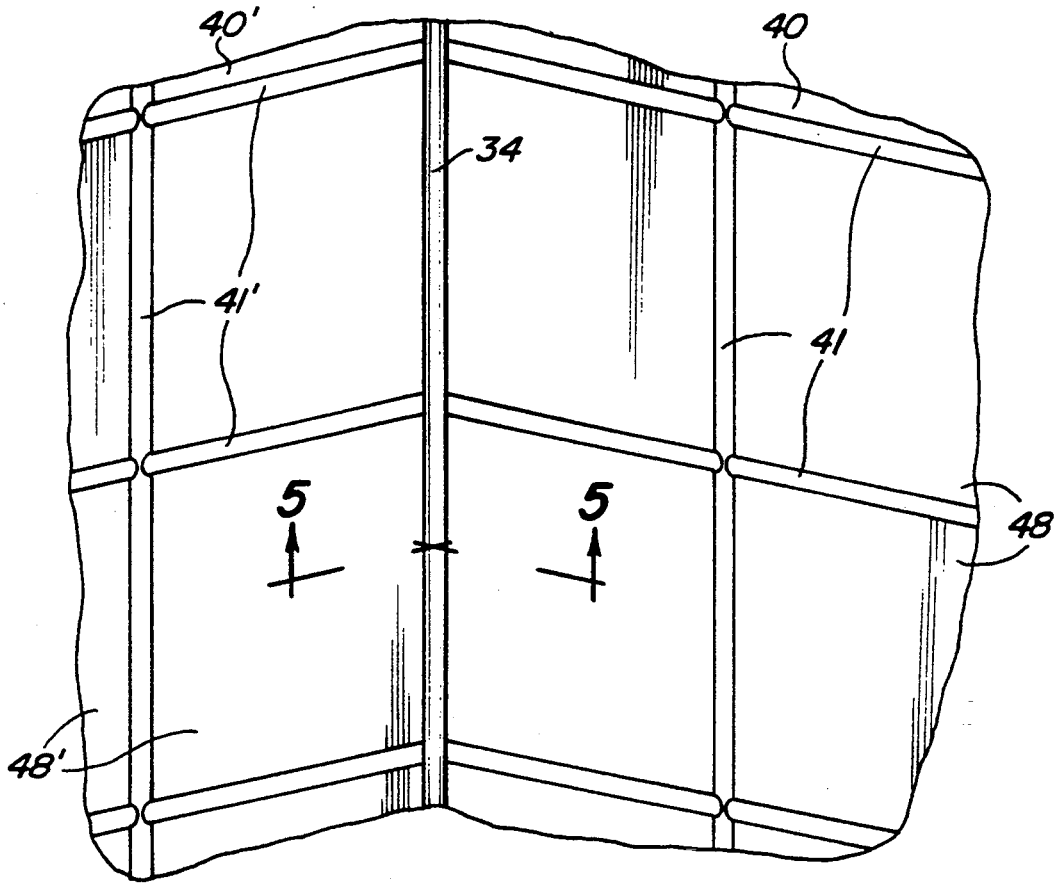
FIG. 4 is a front perspective view of two wall board panels meeting at a corner and inserted into the corner joint, with the interior corner joint of FIG. 1 disposed in the corner.

In one preferred embodiment illustrated in FIG. 3 the base element 11 has a beveled top surface 14, i.e., tapers, only in its outer portion between the rib 30 and its outer edge 17. Base section 11's inner portion 19 between the rib 30 and base element 21 does not have a beveled top surface, i.e., is not tapered.

The base sections 11 and 21 preferably have a width of from about 0.75 to about 1.5 inches, more preferably from about 0.8 to about 1.4 inches, i.e., the distance between 20 and outer edge 17 or 27 is from about 0.75 to about 1.5 inches. In the preferred embodiment illustrated in FIG. 2 the base sections 11 and 21 have different widths, with base section 11 being wider than base section 21, e.g., base section 11 has a width of 1.25 inches while base section 21 has a width of 1.0 inch. In this embodiment the two base sections form an L-shaped cross-section.

Figure 5:
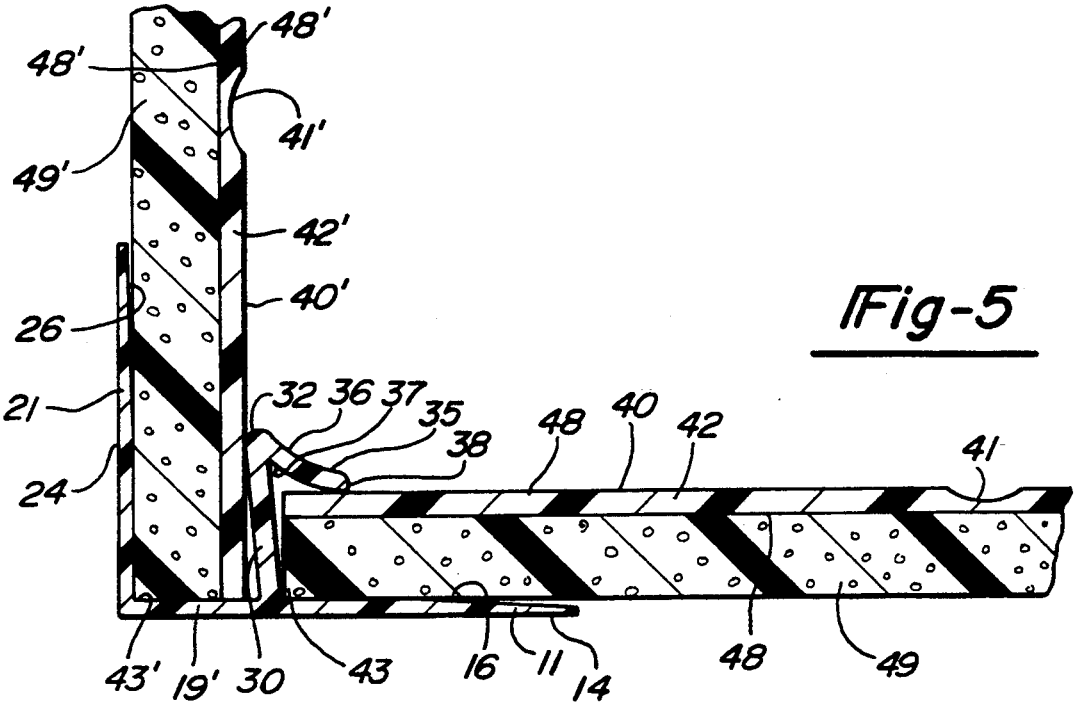
FIG. 5 is a cross-sectional view taken along line 5—5 in FIG. 4.

The height of the rib 30, i.e., the distance from 33 to distal end 32, and its distance from base section 21 is dependent upon the thickness of the wall board panels. The rib 30 is sufficiently high and sufficiently spaced from base section 21 so that, as illustrated in FIG. 5, one wall board panel 40' can be inserted into channel 50 and the other wall board panel 40 can be inserted into channel 51. Preferably wall board panel 40', when inserted into channel 50, also forms an interference fit between base section 21 and distal end 32. Preferably wall board panel 40, when inserted into channel 50, forms an interference fit between base section 11 and end 38 of flange 35. The height of rib 30 and its distance from base section 21 should thus be sufficient to allow insertion of the wall board panels into channels 50 and 51, but not so high or so far from base section 21 as to preclude an interference fit of the wall board panels. Thus, for example, if rib 30 is too high, i.e., extends too far above base section 11 or too close to base section 21, the space between distal end 32 and base section 21 will be too small to allow insertion of wall board panel 40' into channel 50, while the distance between end 38 of flange 35 and base section 11 will be too great to form an interference fit with panel 40'. On the other hand, if rib 30 is too short or too far from base section 21 the space between end 38 of flange 35 and base section 11 will be too small to allow insertion of wall board panel 40 into channel 51, while the distance between distal end 32 and base section 21 will be too great to form an interference fit with panel 40'. Generally this height ranges, depending on the wall board thickness, from about 0.2 to about 0.5 inch. The flange 35 preferably has a width of from about 0.30 to about 0.35 inch.

It can be seen from FIG. 5 that when wall board panel 40' is inserted into channel 50 and wall board panel 40 is inserted into channel 51, the only exposed part of the corner joint 10 is the flange 35. This, together with the concave surface 34 of flange 35 simulates a corner grout line. This results in a seamless appearance of the wall board simulating a tile-in-grout look.

The corner joint 10 is comprised of a polymeric material, preferably a polymeric thermoplastic material and is preferably made by extrusion, preferably profile extrusion. Polymeric thermoplastic compositions useful in extrusion processes are well known to those in the art and are readily commercially available. Some illustrative non-limiting examples of polymeric thermoplastic materials include styrene/acrylonitrile resins; styrene/acrylonitrile/butadiene resin; styrene/butadiene resins; polyolefins such as polyethylene, polypropylene and olefins copolymers and blends, polymethyl methacrylate, polystyrene, polyvinyl chloride, and polyvinylidene chloride.

In one embodiment of the instant invention the extension joints are comprised of profile extruded polystyrene.

The interior corner joint 10, particularly the flange 35, more particularly the outer surface 34 of flange 35, is of a color which matches the color of the simulated grout lines 41, 41' of the wall board panels 40, 40'. This color is visually distinctive from the color of the simulated tiles 48, 48'. Thus, for example, the tiles can be gloss white while the extension joint and simulated grout lines of the wall board are flat white; the tiles can be blue while the extension joint and simulated grout lines are white, etc.

The corner joints 10 are mounted in corners either horizontally (in a horizontal corner such as the juncture of a wall and ceiling) or vertically (in a vertical corner such as the juncture of two walls). The mounting of the corner joints is accomplished in any well known and conventional manner, preferably by the use of an adhesive which may typically be applied to the wall or to the bottom surfaces 14 and 24 of base sections 11, 21. The base sections are then pressed against the wall sections adjacent the corners.

Typically, the corner joint may be mounted in the corner, and the wall board sections are inserted into channels 50, 51. Alternatively, the wall board panels 40, 40' may first be inserted into channels 50, 51 to form an assembly comprised of the corner joint 10 and the wall board panels 40, 40', and this assembly may then be mounted on the underlying walls, with the corner joint 10 being mounted in the corner.

A caulking compound or an adhesive may optionally be used to more securely attach the wall board panels to the corner joint and/or to provide a water-tight seal. If a caulking compound is used the caulk may be applied to the inside of the joint, e.g., into the channels 50, 51 and the wall board panels then inserted into said channels.

The wall board panels 40, 40' may be mounted on the wall by any conventional and well known means. Preferably they are adhered to the wall surface by means of a suitable adhesive.

In the embodiment illustrated in FIGS. 1, 2 and 5 the corner joint is designed to be utilized with the wall board panels 40, 40'. These wall board panels contain top layers 8, 48', simulate tiles embedded in grout, and backing or bottom layers 49, 49'. The bottom layers 49, 49' are preferably comprised of plastic material, preferably a foamed plastic material, such as for example, polyurethane or any of the thermoplastic materials described above. They may be joined to the bottom surfaces of top layers 48, 48' by any known and conventional means such as, for example, a suitable adhesive.

The top layers 48, 48' may be of any known and conventional type which simulate tiles 42, 42' embedded in grout. The grout lines 41, 41' may be formed by grooves machined or otherwise placed in top surfaces of the top layers 48, 48'. One particularly useful type of tile board is disclosed in U.S. application Ser. No. 123,487, filed Nov. 20, 1987, incorporated herein by reference.

A second embodiment of the interior corner joint of the instant invention is illustrated in FIG. 3. Interior corner joint 59 illustrated in FIG. 3 is generally similar in most respects to the interior corner joint 10 illustrated in FIGS. 1, 2 and 5 except that the height of rib 60 is less than the height of rib 30, i.e., in the corner joint 59 rib 60 is shorter than rib 30 in corner joint 10. Corner joint 60 comprises two base sections 61, 71 having top surfaces 66, 76 and bottom surfaces 64, 74 respectively. The base sections are substantially perpendicular to each other and meet at 70. Both base elements 64, 74 have outer edges 67, 77 and inner edges 62, 72. The base sections 61, 71 taper, in the same manner as the base sections 11, 21, toward their outer edge 67, 77. Base section 61 preferably has an inner portion 69 between rib 60 and base element 71 which is not tapered.

Since corner joint 59 is adapted to be used with wall board sections which are thinner than those used with corner joint 10, rib 60 is shorter than rib 30 of corner joint 10. This results in channel 81 being narrower than corresponding channel 51 in joint 10. Also rib 60 is disposed closer to base section 74 than rib 30 is to base section 21. This results in a narrower inner portion 69 than inner portion 19 with a correspondingly narrower channel 80 than channel 50. The flange 65 is similar to flange 35 and includes a concave outer surface 64, and an outer end 68.

An example of wall board panels with which corner joint 59 is designed to be used are wall board panels 40, 40' that contain only top layers 42, 42', i.e., they do not contain bottom layers 49, 49'.

In the preferred embodiment illustrated in FIG. 3 base section 71 is narrower than base element 61, thereby forming an L-shaped cross-section with base element 61.

The corner joints may typically be provided in lengths of from about 5 to about 8 feet.

One particular advantage of the corner joint of the instant invention is that the wall board panels 40, 40' do not have to be sized exactly. Thus, for example, if wall board panel 40 is cut or sized too short the edge 43 thereof will not abut rib 30 as shown in FIG. 5 but will be spaced apart from rib 30 in the direction toward outer edge 17 of base section 11. It will still be disposed in channel 51 and will abut against the upper surface 16 of base section 11 and end 38 of flange 35. If, on the other hand, the wall board panel 40 is cut too long, it may merely be inserted further into cavity 51 to compensate for this greater length. The same holds true for wall board panel 40' and channel 50, except that channel 50, being longer than channel 51, provides a greater latitude for adjustment. Thus wall board panel 40' can have an even greater difference in length than wall board 40 and still be used effectively with the corner joints of this invention.

The corner joints of this invention are particularly useful for bathtub and shower surrounds.

This invention may be further developed within the scope of the following claims. Accordingly, the above specification is to be interpreted as illustrative of only a single operative embodiment of the present invention, rather than in a strictly limited sense.

What is claimed is:

1. A plastic corner joint simulating grout line adapted to join together at least two wall board panels simulating tiles embedded in grout at a corner intersection comprising:

a first base section having an outer edge and an inner edge;

a second base section having an outer edge and an inner edge, said inner edge of said second base section being adjacent and joined to said inner edge of said first base section, said second base section extending from said inner edge of said first base section and being substantially perpendicular to said first base section, said second base section being substantially straight between its outer and inner edges;

a substantially straight rib extending from said first base section toward said outer edge of said second base section, said rib being disposed adjacent said second base section and being canted toward said second base section, said rib, first base section and second base section defining a first channel adapted to receive at least a first wall board panel;

a flange, including an outer surface which is concave in cross-section and simulates a grout line, extending from said rib in the direction of said outer edge of said first base section and being inclined toward said first base section, said flange, rib and first base section defining a second channel adapted to receive at least a second wall board panel in a substantially perpendicular relationship to said at least first wall board panel.

2. The joint of claim 1 wherein said joint is of a color different from the color of said tiles.

3. The joint of claim 1 wherein said joint is of a color substantially the same as the color of said grout.

4. The joint of claim 1 wherein said plastic is thermoplastic.

* * * * *